United States Patent [19]

Axelsson

[11] Patent Number: 4,958,935

[45] Date of Patent: Sep. 25, 1990

[54] METHOD OF BREAKING UP BUNDLES OF ADHERENT HARD FIBERS AND AN OSCILLATING SCREEN

[76] Inventor: Bygg S. Axelsson, Box 3100, S-780 64 Lima, Sweden

[21] Appl. No.: 250,925

[22] Filed: Sep. 29, 1988

[51] Int. Cl.[5] ..... B01F 11/00

[52] U.S. Cl. ..... 366/154; 209/342; 366/108; 366/31

[58] Field of Search ..... 366/31, 32, 150, 154, 366/108, 109, 114, 348, 349, 65, 64; 209/342, 236, 235, 234, 233

[56] References Cited

U.S. PATENT DOCUMENTS

| | | | |
|---|---|---|---|
| 724,866 | 4/1903 | Holl | 52/670 |
| 769,711 | 9/1904 | Pinter | 209/234 |
| 2,141,400 | 12/1938 | Mack | 52/670 |
| 3,533,605 | 10/1970 | Futty | 366/32 |
| 3,664,644 | 5/1972 | Wicklund | 366/31 |
| 3,885,774 | 5/1975 | Harris | 366/31 |
| 4,092,737 | 5/1978 | Sandell | 366/31 |

FOREIGN PATENT DOCUMENTS

| | | |
|---|---|---|
| 648410 | 9/1962 | Canada . |
| 2523905 | 12/1976 | Fed. Rep. of Germany . |
| 2337129 | 2/1979 | Fed. Rep. of Germany . |
| 419308 | 2/1977 | Sweden . |

*Primary Examiner*—Robert W. Jenkins

*Attorney, Agent, or Firm*—McAulay Fisher Nissen & Goldberg

[57] ABSTRACT

A method of breaking up bundles of adherent hard fibers, particularly steelfibers and feeding the obtained single fibers to a mixing device. The method comprises vibrating said bundles of adhering fibers on an oscillating screen to obtain separated fibers, passing said separated fibers being aligned in a plane parallel to the plane of said screen through oblong openings of said screen, through which openings in the main only one fiber at a time can pass and supplying by means of gravity and oscillating force said individual fibers to said mixing device spread over a large area, said area being larger than the area of said screen. The screen (4) has oblong openings (8) having a length corresponding mainly to the length of the fibers and a width being essentially less than the length of said fibers.

20 Claims, 2 Drawing Sheets

METHOD OF BREAKING UP BUNDLES OF ADHERENT HARD FIBERS AND AN OSCILLATING SCREEN

DESCRIPTION

Figure 1:
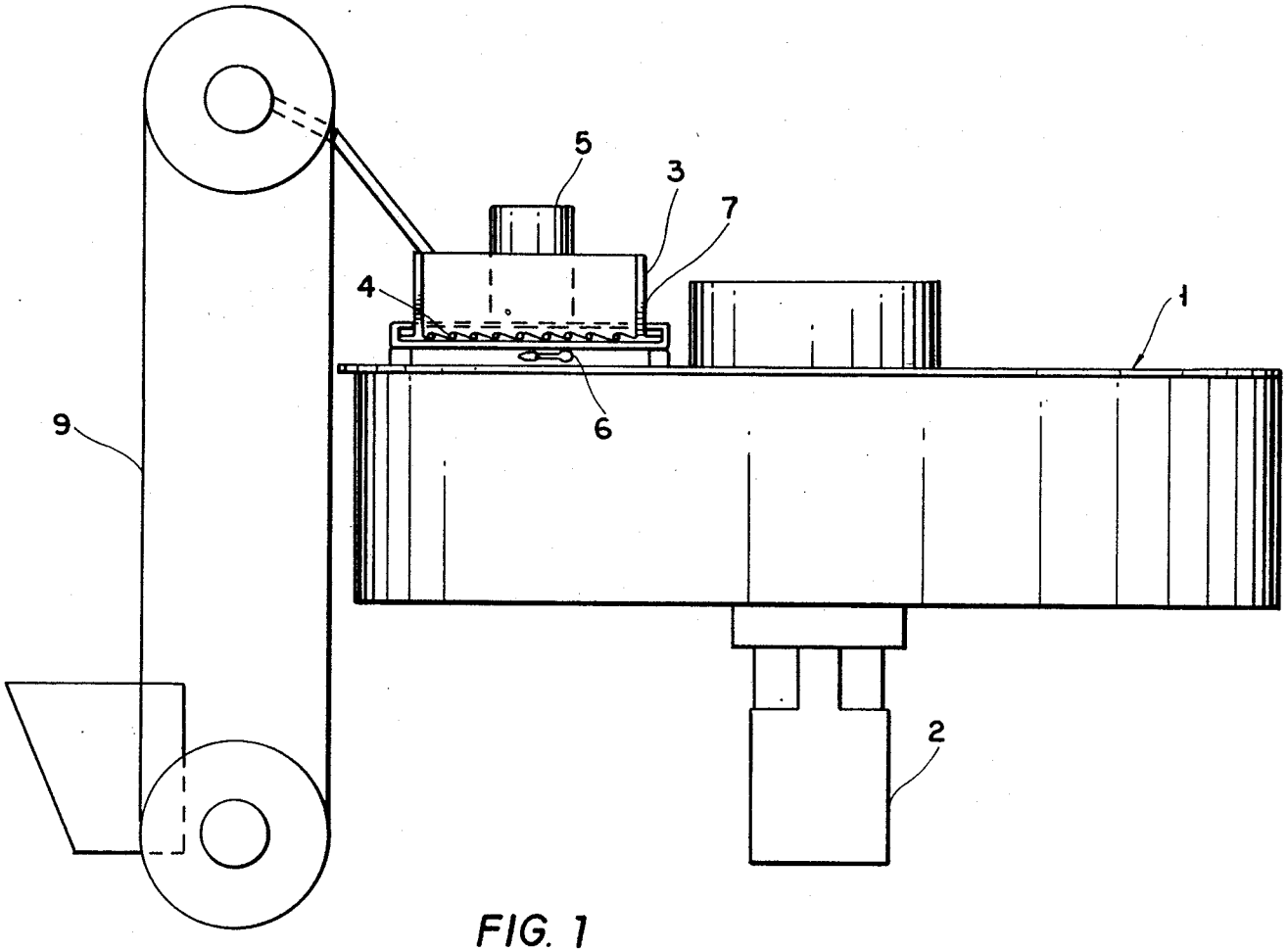

This invention is concerned with a method of breaking up bundles of adherent hard fibers, especially steel fibers, and feeding said defibered or individualized fibers to a mixing device and a vibrating screen for performing said method.

It is previously known it admix precut steel fibers with mixed concrete, thereby the fibers have been added to the concrete mix in a concrete mixer. However, such fibers can only be contained in such concrete mix up to a few percent by volume, since the fibers during mixing and transport show a tendency to clog and form clusters with ballast and cement materials.

It has been proposed to feed the fibers to the dry cement and ballast materials by an air stream. This method is very advantageous. However, steel and other metal fibers are sold only as precut fibers having a short length. These fibers are packed closely together and form lumps or bundles, the fibers of said bundles stick very hard together and are difficult to separate to individualized fibers.

Swedish laid open patent application No. 7508720-5 discloses a method and a device to break up the bundles of fibers by vibrating and/or tumbling on a screen and/or in a tumbler. The feed rate of the fibers to the mixer is varied by an increase or decrease of the rate of motion of the screen or tumbler and/or the discharge opening of the tumbler. The fibers are oriented in a plane by falling by gravity on a vibrating table and therafter aligned by an airstream in a transport pipe.

The purpose of the present invention is to suggest a simple method of defibering fibers obtained as bundles and of supplying the individualized fibers by gravity directly to a mixing device without the intermediate orientation in a plane on a vibrating table and later alignment. The invention also comprises a screen for performing said method.

The purpose of the invention is achieved by a method according to the preamble of claim 1 in that bundles of adhering fibers are vibrated on an oscillating screen in order to individualized said fibers, said separated fibers are passed through oblong openings of the screen, that said fibers before being passed through said openings are aligned in a plane parallel to the plane of the screen by said vibrational movement, the openings have such a shape that mainly only one fiber at a time can pass through one and the same opening, and that by means of gravity and oscillating force said individualized fibers are supplied to said mixing device over a large area, said area being larger than the area of said screen.

The screen for performing the method comprises a screening means having oblong openings, the length of said openings being mainly equal to the length of said fibers and the width of said opening being essentially less than the length of said fibers.

The invention will now be described by means of the drawing.

Figure 2:
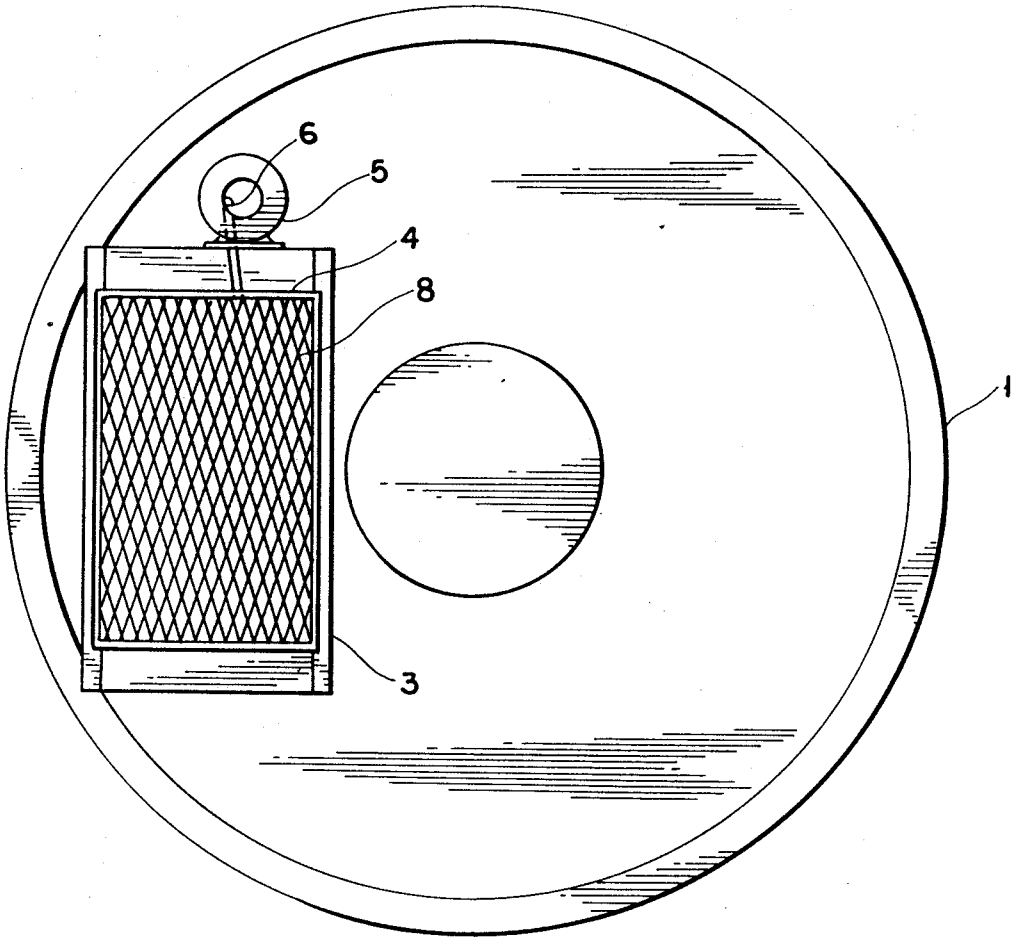

FIG. 1 shows a cross section through a concrete mixer station comprising a screen according to the invention and FIG. 2 shows the concrete mixer station from above.

The concrete mixer station of FIG. 1 comprises a mixing means 1 having mixing elements which are not shown, said elements are driven by a motor 2. A screen 3 is arranged on the mixing means 1, said screen has a screening means 4. The screening means is given an oscillating movement by a motor 5 via an eccentric member 6. Said screening means 4 has oblong openings 8, e.g. rhombic openings as shown in FIG. 2.

The screen 3 is provided with side walls 7 to retain the fibers supplied to the screen when the screening means is moving backwards and forwards. The screening means 4 covers a large area of the mixing means 1. Advantageously it covers an area as large as possible. In FIG. 2 the width of the screening means is about half the radius of the round mixing tank 1. The screening mean has such a length that all fibers fall within the mixing tank 1. The screen can, of course, be placed nearer the center of the mixing tank and thus having both a greater length and width. By varying the number of revolutions of motor 5 the velocity of said screening means can be varied and thus the amount of supplied fibers can be increased or decreased.

The openings of the screening means must be oblong and preferably have rhomboidic shape, i.e. the openings include both rectangular and rhombic shape. The shape of the openings must have such a shape that mainly only one fiber at a time can pass through one and the same opening. The largest dimension of an opening must be of the same order of magnitude as the fiber and the dimension at a right angle to the longest dimension must be small such that two or more fibers sticking together cannot pass through the opening. A practical least dimension of a rhomboidic opening is such a length that the sum of the length of two adjacent sides is slightly greater than the length of a fiber. In that case, only fibers having a longitudinal axis forming an angle against the plane of the screening means can pass. A preferable practical greatest dimension of rhomboidic openings is such a length that the sum of the length of two adjacent sides is twice the length of the fiber. Of course, the width of the openings must be such that in the vast majority of cases, bundles of fibers of two or more cannot pass. Preferably the surface of the screening means is not even but is provided with elevations and corresponding depressions (negative elevations), i.e. the level of the top surface is having regular or non-regular variations.

An example of a preferred screening means is a means made of expanded metal and having rhombic openings. The openings of an expanded metal make an acute angle with the plane of the screening means. As an example it may be mentioned that, for fibers having a length of 18 mm an expanded metal screen having rhombic openings is very suitable, the openings having a greatest diagonal of 25 mm and a second diagonal of 12 mm. It is understood that the size of the openings depends on the length of the fibers.

When using the present method the fibers are supplied in the form of bundles of fibers and of course, there are single fibers. Such bundles are fed to the screen 3 via an endless chain elevator 9, said screen is placed directly over said mixing tank 1. Simultaneously or preferably in advance, naturally moist sand is fed to the mixing means 1. Thus, the sand must not be dry. Due to the fact that the fibers pass through said screening means, mainly only one fiber at a time passes through one and the same opening, over a large area, the supply of fibers comprises many fibers per unit of time over a large area. Thus many fibers can be supplied without clogging in the mixing tank. Thanks to the fact that the screen is oscillating, the fibers obtain a component of movement parallel to the plane of the screening means. Therefore the fibers are spread over an area which is larger than the area of the screening means. The mixing device 1 will distribute the fibers in the concrete before they are able to clog together. Then, or possibly simultaneously with the sand, other ballast material, e.g. silicon dioxide, is added. Following the ballast materials cement and thereafter water is added forming the mixed concrete. This concrete can be sprayed. This spraying orients the fibers in one direction in the concrete.

The present invention is not limited to the production to reinforced concrete but can be used in the production of other masses containing fibers, e.g. asphalt, bitumen.

The method is not limited to the described open mixing device but can be used with other mixing devices, e.g. screw mixing devices.

I claim:

1. An oscillating screen for breaking up bundles of adherent hard fibers for defibering them to produce defibered or individualized fibers, comprising:

screen means for obtaining separated fibers;

said screen means including an oscillating screen means having oblong openings, said screening means being made of expanded metal; and said openings having a length corresponding mainly to the length of said fibers and a width which is essentially less than the length of said fibers.

2. The screen according to claim 28, wherein said screening means has a planar surface and has elevations and depressions relative to said planar surface.

3. The screen according to claim 2, wherein each said opening lies in a plane forming an acute angle relative to the planar surface of said screening means.

4. The screen according to claim 2, wherein the openings of the screening means have the form of a rhomboid.

5. The screen according to claim 1, wherein the openings of said screening means have the form of a rhomb.

6. The screen according to claim 1, wherein the openings of the screening means have the form of a rhomboid.

7. A method of breaking up bundles of adherent hard fibers, particularly steel fibers for defibering them to produce defibered or individualized fibers, and feeding said defibered or individualized fibers to a mixing device, the method comprising:

vibrating said bundles of adhering fibers on an oscillating screen to obtain separated fibers;

passing said separated fibers being aligned in a plane parallel to the plane of said screen through oblong openings of said screen, through which openings in the main only one fiber at a time can pass; and supplying by means of gravity and oscillating force said individual fibers to said mixing device spread over a large area, said area being larger than the areas of said screen.

8. The method according to claim 7, forming each opening to lie in a plane forming an acute angle relative to the plane of the screening means.

9. The method according to claim 7, forming the openings of the screening means in the form of a rhomb.

10. The method according to claim 7, fabricating the screening means of expanded metal.

11. The method according to claim 7, forming the openings of the screening means as a rhomboid.

12. The method according to claim 11, forming the openings of the screening means into a rectangular shape.

13. The method according to claim 7, including supplying the individual fibers directly by gravity to the mixing device free of intermediate orientation on a vibrating table.

14. The method according to claim 7, including providing the screening means openings with a length corresponding mainly to the length of the fibers and a width essentially less than the length of the fibers.

15. The method according to claim 7, including providing the screening means with elevations and depressions relative to its plane.

16. The method according to claim 7, including the oscillation of the screening means to control the amount of supplied fibers.

17. The method according to claim 7, including providing walls on the screening means for retaining the fibers thereon when oscillating the screeening means.

18. The method according to claim 7, including providing the screening means openings with a length dimension substantially twice the width dimension.

19. An oscillating screen for breaking up bundles of adherent hard fibers for defibering them to produce defibered or individualized fibers, comprising:

screen means for obtaining separated fibers;

said screen means including an oscillating screening means having oblong openings, said screening means being formed of an expanded metal in which said openings lie in a plane forming an acute angle with the plane of the planar surface of said screening means; and said openings having a length corresponding mainly to the length of said fibers and a width which is essentially less than the length of said fibers.

20. The screen according to claim 19, wherein the screening means has a planar surface with elevations and depressions relative thereto.

* * * * *